United States Patent [19]

Kitagawa et al.

[11] Patent Number: 4,567,351

[45] Date of Patent: Jan. 28, 1986

[54] ELECTRIC SPACE HEATER EMPLOYING A VAPORIZABLE HEAT EXCHANGE FLUID

[75] Inventors: Yoshiaki Kitagawa, Osaka; Koichiro Ohki, Ibaraki; Toshio Sarada, Moriguchi, all of Japan

[73] Assignee: Matsushita Electric Works, Ltd., Osaka, Japan

[21] Appl. No.: 520,582

[22] Filed: Aug. 5, 1983

[51] Int. Cl.[4] ..... H05B 1/02; H05B 3/82; F24H 3/08; F24D 13/04

[52] U.S. Cl. ..... 219/341; 126/101; 165/146; 165/181; 219/328; 219/365; 237/16

[58] Field of Search ..... 219/341, 365, 328; 165/146, 181; 237/16–18; 126/101

[56] References Cited

U.S. PATENT DOCUMENTS

| | | | |
|---|---|---|---|
| 1,007,000 | 10/1911 | Gold | 219/341 |
| 1,124,548 | 1/1915 | Steller | 219/341 X |
| 1,770,527 | 7/1930 | Lenahan | 237/17 |
| 1,866,221 | 7/1932 | Pennington | 219/341 |
| 2,225,850 | 12/1940 | Wright | 219/365 X |
| 2,268,361 | 12/1941 | Walker et al. | 165/146 X |
| 2,276,407 | 3/1942 | Manzer | 219/341 X |
| 2,521,173 | 9/1950 | Koral | 219/341 |
| 2,841,685 | 7/1958 | Alexander | 219/341 |
| 3,422,249 | 1/1969 | Grossinger | 219/341 |
| 4,124,794 | 11/1978 | Eder | 219/341 X |

FOREIGN PATENT DOCUMENTS

| | | | |
|---|---|---|---|
| 828275 | 2/1952 | Fed. Rep. of Germany . | |
| 1843348 | 12/1961 | Fed. Rep. of Germany . | |
| 524239 | 5/1921 | France | 219/341 |
| 870401 | 12/1941 | France | 219/341 |
| 924125 | 3/1947 | France | 219/341 |
| 1003983 | 11/1951 | France | 219/341 |
| 1217201 | 12/1959 | France | 219/341 |
| 1192720 | 5/1970 | United Kingdom . | |

*Primary Examiner*—A. Bartis

*Attorney, Agent, or Firm*—Stevens, Davis, Miller & Mosher

[57] ABSTRACT

An electric space heater includes a housing having inlet and outlet openings and enclosing a heat exchange structure having a main tube and a secondary tube communicated by conduit pipes to define a closed space, exhausted of air, in which a working fluid performs a cycle of vaporization and condensation. The main and secondary tubes each have a uniform diameter and are horizontally disposed in parallel relation with the conduit pipes extending upwardly from the main tube to the secondary tube. Extending the entire length of the main tube is a protective pipe enclosing an electric resistance heating element. The working fluid fills the main tube to a level completely immersing the protective tube, the remainder of the closed space being empty. The main and secondary tubes are provided with spaced radiation fins, with the fins on the secondary tube being at a wider spacing than those of the main tube. In operation the working fluid is vaporized by the heating element and expands into the secondary tube where it condenses to give up its latent heat of vaporization to the air passing through the housing. The condensed fluid flows by gravity through the conduit pipes back to the main tube thus producing a continuous cycle of vaporization and condensation in the closed space. The heating element is controlled by an automatically resettable control thermostat provided on the secondary tube. A manually resettable safety thermostat operable at a higher temperature than the control thermostat is provided on the main tube for disconnecting the heating element to prevent damage to the space heater from excessive heating.

3 Claims, 14 Drawing Figures

ELECTRIC SPACE HEATER EMPLOYING A VAPORIZABLE HEAT EXCHANGE FLUID

BACKGROUND OF THE DISCLOSURE

1. Field of the Invention

This invention is directed generally to a heat pipe apparatus for heating applications, more particularly to a heat pipe apparatus adapted to be employed as a heating appliance of natural convection type.

2. Description of the Prior Art

There have been proposed heater units of the type adapted for use in natural convection heating, such as shown in FIG. 1, wherein an elongated rod-like electric heat source 6, for example a sheathed electric heater composed of a heating coil and an insulating covering, is provided with a series of spaced fins 7 attached to the outer surface thereof. In the above heater unit, it is most desirable for increasing heat transfer efficiency to have an intimate contact between the entire periphery of the outer surface of the heat source 6 and the fins 7. However, a hole in each fin 7 is required for facilitating the operation of inserting the heat source 6 therethrough and having a diameter slightly larger than the outer diameter of the heat source. This results in a loose contact or gap between the heat source 6 and fins 7. To fill the gap after inserting the heat source 6, one alternative is to enlarge the diameter of the heat source 6 to attain intimate contact, but it is unlikely that the heat source of this type will have such self deforming ability. Therefore, the above heater units will suffer from the gap between the heat source and the fins, which will give rise to poor heat transfer efficiency from the heat source to the surrounding air.

Further, almost all of the conventional heat sources are seen to have a considerable temperature gradient along the length thereof, thus it often occurs in such heater units that the fins are heated to different temperatures depending on their location along the length of the heat source, which will cause lowering of the capacity of the heater unit in spite of it being required to operate with maximum efficiency. Another disadvantage resulting from the construction of the above heater unit is that the fins may be sometimes overheated to such an extent that mild heating performance is not available.

In the meanwhile, the above heater units are designed to be used normally as incorporated in a housing 1, as shown in FIG. 4. In actual situations, it will frequently be required to increase the heat transfer capacity of the heater units depending upon the space in which they are installed. For increasing the amount of heat to be released, adding an extra number of fins to the heat source may be the first thought, but mere addition of fins of fixed length to the heat source proves to be less effective by the reason that fins spaced too closely together will certainly impede the upward flow of air through the fins so as to reduce the amount of heat released from the fins to the air. Thus, there remains the choice of either elongating the heat source so as to increase the number of fins employed while maintaining the clearance between the adjacent fins at an optimum value or to add another heater unit with the same heat source so as to increase the total number of fins. However, the former measure has a disadvantage in that the old heater unit, replaced by a new one of greater heat transfer capacity, is abandoned and wasted, and the latter measure has a disadvantage in that the addition of extra heater units incurs increased equipment cost. This results in higher operating costs.

SUMMARY OF THE INVENTION

The above disadvantages have been eliminated by the present invention, which introduces a unique structure combined with the well-known function of a so-called heat pipe to attain a superior heat transfer from a heat source to the surrounding air. The heat pipe apparatus of the present invention includes a main tube and a secondary tube communicated by conduit pipe means to define a closed space in which a heat transfer or working fluid performs the cycle of vaporization and condensation. The main and secondary tubes are arranged to be in parallel relationship with one another and disposed substantially horizontally, with the conduit pipe means extending upwardly from the main tube to the secondary tube. Extending through the main tube is an elongated heat source which is in thermal contact with the working fluid therein, which is preferably in liquid form ready to vaporize. The vaporized fluid will expand in all portions of the closed space and then condenses on the inner surface of the tubes and conduit pipe means to give up its latent heat of vaporization to the surrounding air. The condensed fluid will thereafter move through conduit pipe means back to the main tube by gravity so as to continuously circulate in the closed space. The main and secondary tubes are respectively provided with a series of vertical radiation fins arranged in spaced apart relationship along the length of the tubes so as to increase the surface area for releasing the heat and thus give off heat efficiently. With this structural arrangement the heat source is kept apart from the fins, each tube after receiving the fins, but before receiving the heat source and the working fluid, can be subject to any processing operation, therefore each tube can be processed to enlarge its diameter so as to fit snugly into the holes of the fins. For example, expanding the tube by running a ball having a larger diameter through each tube, thereby presenting a tube-fin construction which is free from gaps between the tube and fins and thus providing a maximum heat transfer by conduction from the tube to the fins which give off the heat to the surrounding air.

Accordingly, it is a primary object of the present invention to provide a novel heat pipe apparatus which is capable of transferring efficiently the heat from the heat source to the surrounding air without loss in the path from the heat source to the fins and is most suitable for heating appliances of the natural convection type.

Generally, the amount of heat transferred in a unit of time, that is, heat transfer coefficient, depends on the temperature difference between the boundaries of a heating system so that it will have an optimum raised temperature on the heat source in relation to the incoming air of substantially lower and constant temperature in order to give as much heat as possible in unit of time. Consequently, all the fins are required to have substantially an equally raised temperature for maximum heat transfer efficiency. In other words, any variation of temperature with the differing locations of the fins will certainly reduce the heat transfer efficiency of the whole tube or pipe. In view of this, the present invention is devised to utilize a working fluid for heating all the fins arranged along the length of the tube up to an equal temperature.

It is therefore another object of the present invention to provide a heat pipe apparatus which is capable of averaging the temperature gradient associated with most of the heat source available so as to efficiently give off heat generated by the heat source.

In a preferred embodiment, the fins on the secondary or upper tube are spaced longitudinally along the length of the tube at a wider spacing or clearance than those on the main or lower tube for the purpose of increasing the total amount of heat transferred from both tubes to the air. It has been recognized that the above heat transfer coefficient will drop with the reduction in temperature difference between the fins and the surrounding air, from the fact of which it is highly desirable for heaters with a series of fins, particularly those of the natural convection heating type, that the air should pass rapidly through the fins to allow the fins to be continuously subject to the incoming air of lower temperature rather than to stagnate and to be kept in contact for a longer time with fins which are reluctant to give off more heat to the air already receiving the heat therefrom and having a raised temperature. This should be taken into consideration where two or more tubes with fins are arranged vertically for convection heating purpose, because the upper tube with the fins can act, under certain conditions, to impede the upward flow of the air passing through the fins on the lower tube to such an extent that the amount of heat released from the upper tube cannot compensate for the reduction in the lower tube. The above preferred embodiment provides a solution to the foregoing problem by arranging the fins on the upper tube at a wider spacing than those on the lower tube such as not substantially to decrease the amount of heat from the lower tube and, at the same time to add to the amount of heat from the upper tube, resulting in an increase in the total amount of heat from both tubes.

Accordingly, it is a further object of the present invention to provide a heat pipe apparatus capable of operating at its maximum efficiency to release a maximum amount of heat from the whole apparatus despite the fact that the tubes are disposed one above the other.

Associated with the above advantageous feature, it has been found most effective that the addition of a secondary tube without a heat source will lead to increased heat transfer capacity of the whole apparatus without the necessity of employing an extra heat source, making it possible to add extra heat transfer capacity at a lower cost, which is in contrast to the case where another heat source with the same fins should be required to be added for increasing the heat transfer capacity.

Thus, it is a still further object of the present invention to provide a heat pipe apparatus which is capable of increasing its heat transfer capacity at lower costs.

Also included in the present invention is a more advantageous feature in which two kinds of thermostats are incorporated to prevent unusual or excessive heating of the apparatus by interrupting the heat source when the apparatus is heated to a high temperature, one being of the type which is resettable automatically with lowering temperature to the operating temperature, and the other being of the type which is resettable only by a manual operation. The former thermostat is utilized to sense the accidental temperature rise due to circumstances not resulting from the apparatus itself, while the latter is to sense the same due to causes resulting from the apparatus itself, whereby attaining a suitable remedy, depending upon the kind of trouble, to ensure safe operation of the apparatus.

These and other objects and advantages of the present invention will become apparent from the detailed description thereof taken with the accompanying drawings.

DETAILED DESCRIPTION OF THE PREFERRED EMBODIMENTS

Figure 1:
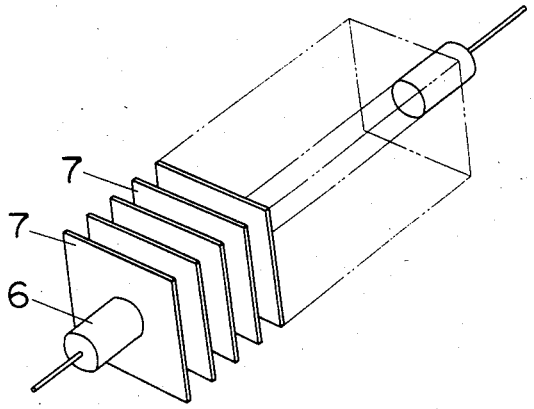
Fig. 1 (Prior Art)
FIG. 1 is a perspective view partly in schematic representation showing a typical prior heater unit.
Figure 2:
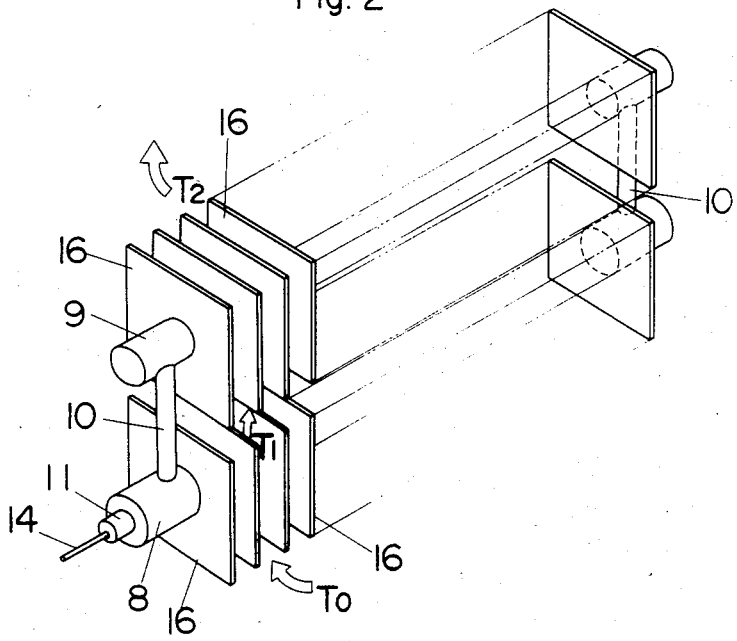
FIG. 2 is a perspective view partly in schematic representation showing a heat pipe apparatus embodying the present invention.
Figure 3:
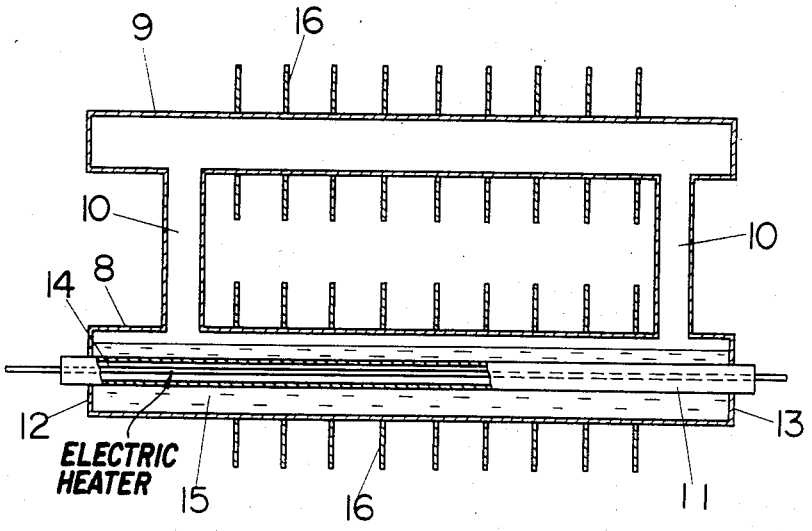
FIG. 3 is a longitudinal section of the heat pipe apparatus as shown in FIG. 2.
Figure 4:
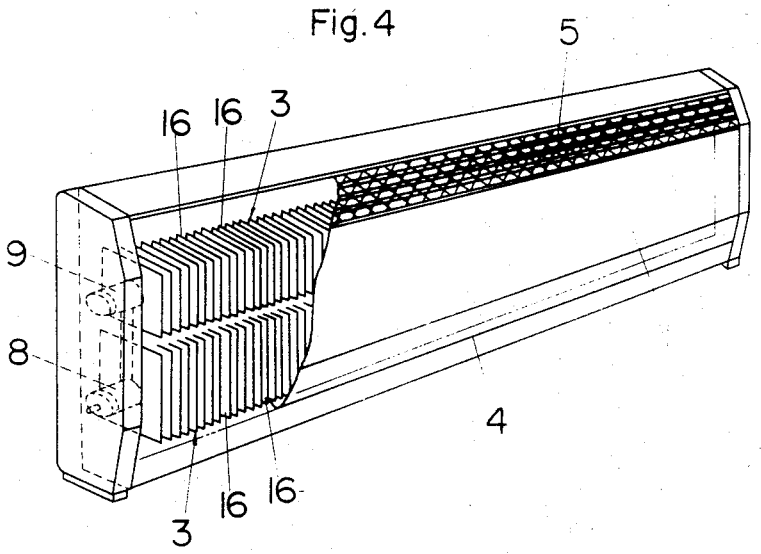
FIG. 4 is a perspective view partially cutaway, of a housing incorporating the above heat pipe apparatus.

Referring now to the drawings, and particularly to FIGS. 2 through 4, there is illustrated one preferred embodiment of a heat pipe apparatus adapted for use in natural convection heating. The apparatus includes a main tube 8 which in use is disposed substantially horizontally, a secondary tube 9 disposed above the main tube 8, a pair of vertically extending conduit pipes 10 interconnecting the main and secondary tubes at both longitudinal ends to communicate the main tube 8 with the secondary tube 9 so as to define a closed space in the apparatus, an elongated heat source 14 extending through the main tube 8, and a heat transfer or working fluid within the main tube 8 in liquid form at the operating temperature of the apparatus. The main and secondary tubes are of uniform diameter, having respectively a series of radiation fins 16 evenly spaced longitudinally along the length thereof. Both longitudinal ends of each tube are sealed to define said closed space or loop by the members 8, 9 and 10, which are preferably exhausted of air and coated with a capillary lining on the inner surfaces thereof. Extending coaxially through the main tube 8 is a protective pipe 11 whose longitudinal end portions are sealed respectively in the end walls 12 and 13 of the main tube 8. Said heat source 14 is a so-called electric sheath heater, composed of a heating coil and a ceramic insulating material encircling the coil, and extends through the entire length of the protective pipe 11, with its longitudinal ends projecting therefrom to be connected to an electric power source (not shown). Said heat transfer or working fluid 15 is a fluid capable of transporting a large amount of heat by undergoing a cycle of vaporization and condensation, and is selected in the present invention to be in the liquid phase at the normal operating temperature and to have a low boiling point below the temperature which the heat source is anticipated to reach. For the purpose of domestic heating, ammonia, water, or Freon may be employed as the working fluid 15. The working fluid 15 within the main tube 8 is in an amount sufficient to surround entirely the protective pipe 11 so that the heat from the heat source 14 can be transported without loss of the working fluid 15.

Figure 5:
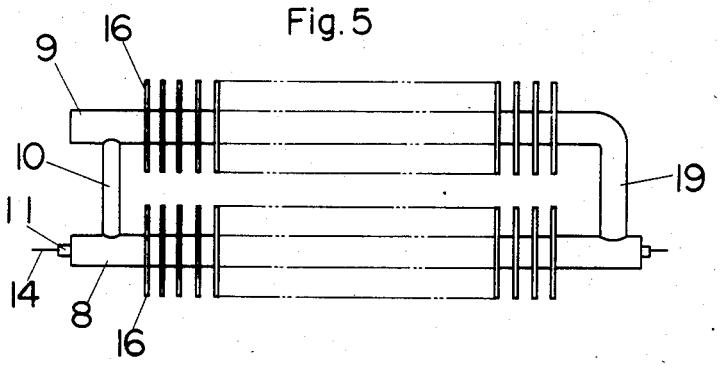
FIG. 5 is an elevational view showing one modification of the above heat pipe apparatus.
Figure 6:
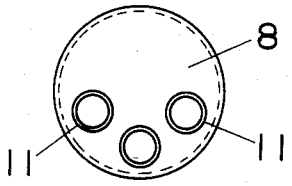
FIG. 6 is a side view showing another embodiment of the present invention.

When the heat source 14 is switched on, it heats the protective pipe 11 to vaporize the working fluid 15 which is in direct contact therewith. The vapor thus formed will expand and fill the interior of the entire closed space with a portion flowing through the conduit pipes 10 into the second or upper tube 9 and then condensing on any colder surface including the conduit pipes 10, the main tube 8, and secondary tube 9 so as to give up its latent heat of vaporization to the surrounding air mainly by means of spaced fins 16 on both the main and secondary tubes 8 and 9. The working fluid 15 liquified in the secondary or upper tube 8 will flow through the conduit pipes 10 back down to the main or lower tube 8 to be subsequently heated to vaporize, while the working fluid remaining within the main tube 8 will give off heat by its vaporization as well as by conduction while in the liquid form. In this manner the working fluid 15 repeats its cycle of vaporization and condensation, the heat can be rapidly transferred from the heat source to the entire apparatus so as to heat uniformly the main and secondary tubes 8 and 9. The conduit pipes 10 are preferably disposed vertically to facilitate the downward flow of the liquified working fluid 15 to the main tube 8, but they may be inclined so long as gravity effect may be expected to flow the liquified fluid from the secondary tube 9 to the main tube 8. In the above embodiment, said closed space is in the form of a closed loop so that the vaporized fluid will circulate in one direction along the loop as it condenses in this circulation, whereby there is less chance for the vaporized fluid to conflict with the liquified or condensed fluid in their circulating movements, resulting in effective circulation of the working fluid 15 within the whole apparatus. In this closed loop configuration the provision of two opposed conduit pipes 10, is more effective than to have the upper end of the one conduit pipe 10 projecting upwardly into the secondary tube 9, while the lower end of the other conduit pipe 10 extends downwardly into the working fluid 15 in liquid form within the main tube 8. In addition, the one conduit pipe 10 may be formed by bending an integral extension 19 from te secondary tube 9, as shown in FIG. 5. Also, referring to FIG. 6 which shows another embodiment of the present invention, more than one set of the heat source 14 and the protective pipe 11 may be used to extend through main tube 8 for the purpose of increasing the heating capacity of the apparatus.

Figure 7:
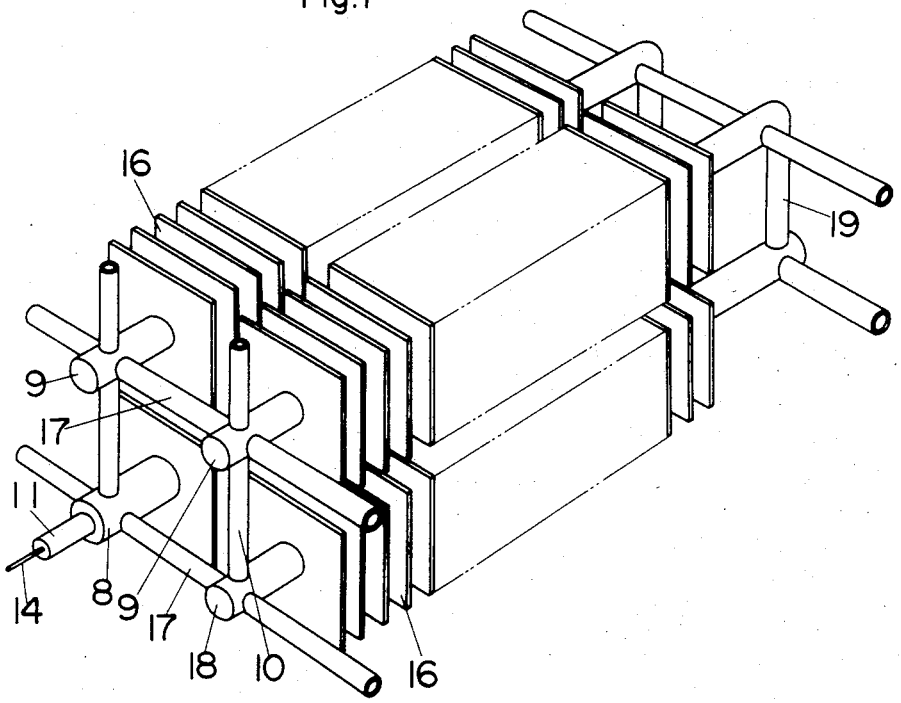
FIG. 7 is a perspective view partly in schematic representation of a further embodiment of the present invention in which three secondary tubes are combined with one main tube.

Referring to FIG. 7, there is illustrated a further embodiment of the present invention which includes more than one secondary tube 9 having the same radiation fins 16 with respect to the main tube 8 in order to obtain an increased heating capacity of the apparatus. In this embodiment, one secondary tube 18 is disposed laterally of the main tube 8 and the remaining two secondary tubes 9 disposed respectively above a pair of laterally disposed main tube and secondary tube 19. The laterally adjacent secondary tubes 9 in the upper row are interconnected by a pair of horizontal conduit pipes 17 in the same way as the laterally adjacent main and secondary tubes 8 and 18 are interconnected by a pair of horizontal pipes 17, while each set of vertically disposed tubes are connected by the same vertical conduit pipes 10. Further, another secondary tube may be disposed above the secondary tube 9 to be cooperative therewith.

With this structural arrangement of the heat pipe apparatus, extra second tubes can be easily added through one or more conduit pipes by utilizing a conventional pipe coupling technique to increase the number of secondary tubes in relation to the one main tube 8, such as to power up the apparatus without requiring additional heat sources or without replacing the old heat source with a new one of greater heat capacity. Also, the hollow structure of the main and second pipes make it possible to easily enlarge the outer diameters of the tubes with the fins attached thereon, such as by running a ball of larger diameter through the tubes so that the fins 16 can snugly fit on the tubes, attaining a connection free of a gap between the tubes and the fins, thus resulting in good conduction from the heated tubes to the fins. Such gap would be inevitable for the aforementioned prior heater unit in which fins are attached directly on the heater source, not permitting itself to be processed to enlarge the diameter.

The heat pipe apparatus of the present invention is in most cases used for domestic application in the form of being incorporated, as shown in FIG. 4, within a housing 1 having a lower port 4 through which the air enters to receive heat from the apparatus. The heated air will then flow upwardly out through an upper port 5 of the housing 1 to complete the air circulation through the apparatus by natural convection. In the apparatus, the working fluid will convey heat from the heat source 14 to the fins 16 to the main and secondary tubes 8 and 9 in the form of vapor and/or liquid so as to prevent excessive heating and achieve mild and comfortable heating. It is noted at this point that the apparatus of the present invention has a unique feature that the heat source 14 is inserted within the main tube 8 to present an advantage over the conventional heat pipe device, to which a heat source is applied externally, in that the heat from the heat source 14 can be effectively transported to the working fluid without being dissipated. Thus, the apparatus of the present invention can be said to have good heat exchanging performance.

Although said protective pipe 11 which receives the heat source is not essential to the present invention, it brings about advantageous features as follows: (i) the heat source 14 can be easily replaced by a new one when damaged; (ii) the heat source 14 is not required to be directly fixed to the main tube 8 and is not subject to an excessive high temperature which would otherwise be applied if brazing or the like processing were required for sealing the heat source in the tube for the case where the heat source must be directly fixed to the tube, so that there is no fear in the above structure of breaking the electrical insulation of the heat source, by excessive high temperature during the sealing operation which could be the cause of impairing the heat source itself; (iii) a large variety of heat sources can be employed easily since this structure will not require the heat source to be submerged directly in the working fluid; and (iv) the protective pipe 11 allows the heat source 14 to be fixed rather loosely thereto so that it will be relatively free to expand and contract during the heat cycle of the heat source 14, bringing about no substantial stress in the connecting portion between the heat source 14 and the pipe 11 and minimizing the occurrence of deformation in that connection. In connection with the above item (iii), hot water may be employed as the heat source to flow through the protective pipe 11.

Figure 8:
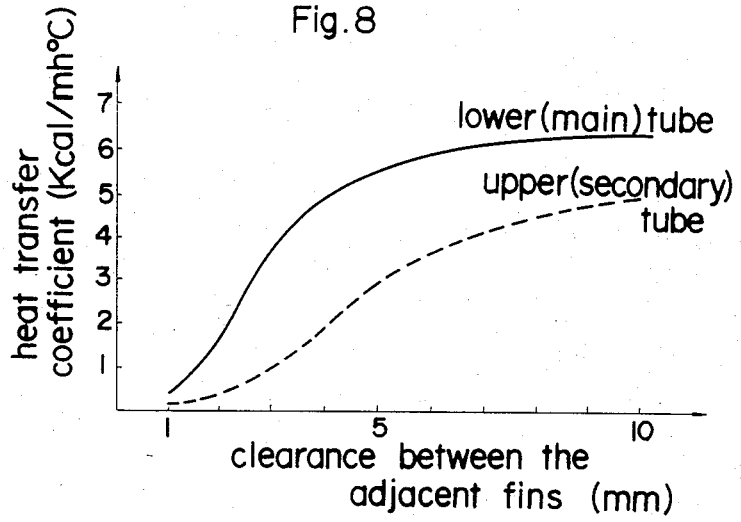
FIG. 8 is a graphical representation showing variations of heat-transfer coefficient per one fin of the lower (main) tube and the upper (secondary) tube with the spacing value between the adjacent fins arranged along the length of the tubes.
Figure 9:
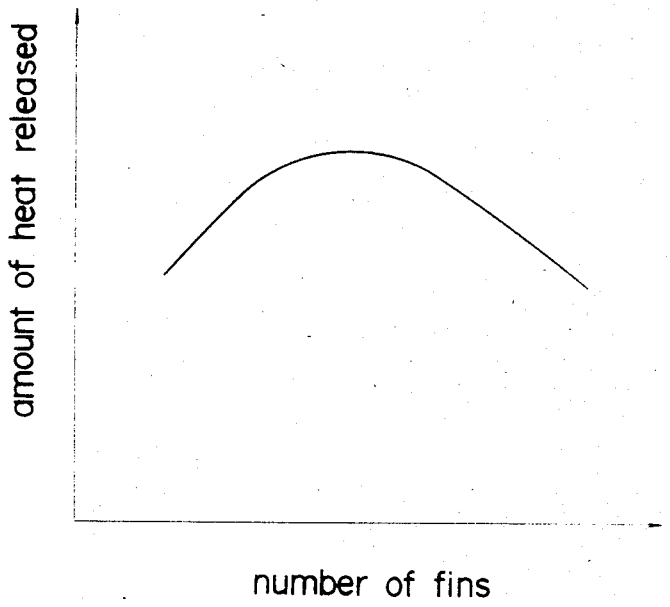
FIG. 9 is a graphical representation showing general variations of the amount of heat released from the entire area of the fins of the tube of a limited length with the spacing value between the adjacent fins evenly spaced apart along the length of the tube.

To investigate the effectiveness of the apparatus tests have been conducted with the understanding that, as illustrated in FIG. 2, the air entering the fins 16 on the main or lower tube 8 at an initial lower temperature of $T_0$ will flow upwardly through the fins 16 on that tube 8 by natural convection to be heated to a temperature of $T_1$, and the air of thus raised temperature $T_1$ will thereafter enter the fins 16 on the secondary or upper tube 9 to receive more heat therefrom so as to have a still raised temperature of $T_2$. The tests were performed in order to obtain heat transfer characteristics of the fins with varying spacing or clearance between the longitudinally adjacent fins 16, the characteristic being the heat transfer coefficient per one fin on each of the upper and lower tubes. For this purpose, there was employed a number of apparatuses having the same configuration, that is, a series of rectangular fins of uniform dimensions were arranged in evenly spaced relationship along the length of each tube and the upper and lower tubes were spaced vertically at a fixed distance, except that the apparatuses had different spacings or clearances between the adjacent fins 16. FIG. 8 shows in graphical representation the above heat transfer coefficients in a solid curve for the lower (main) tube 8 and those in a phantom curve for upper (secondary) tube 9. It can be seen from FIG. 8 that the heat transfer coefficient for the fins on both lower (main) and upper (secondary) tubes exhibit a like tendency to increase progressively with increasing distance or clearance between the adjacent fins and no longer increase beyond a certain value. Also known from the same Figure is that the lower tube 8 has a higher heat transfer coefficient over the entire range of differing clearances than that of the upper tube 9, for example the coefficient for the fin on the upper tube 9 at a clearance 5 mm is nearly a half of that on the lower tube 8 at the same clearance, which, when taking into consideration that the air entering the fins on the upper tube has a naturally higher temperature than the air entering initially the fins on the lower tube, is well coincident with the general recognition that the amount of heat given off from each fin in a unit time will increase with the increase in the temperature difference between the fins and the incoming or fresh air. The above explains that the air when flowing by natural convection will increase its flow rate with increasing clearance between the longitudinally adjacent fins, such that each fin can be subjected to a higher amount of incoming air of lower temperature for efficiently releasing heat to the air, and that there is a certain value beyond which the air no longer increases its flow rate in favor of increasing the amount of heat to be released from each fin to the passing air. Thus, it is advantageously required for the purpose of increasing heating capacity to pass as much of the fresh air of low temperature through the fins rather than to retain the already heated air around the fins which are reluctant to give off more heat to the air of raised temperature. On the other hand, it is of course effective for increasing the heating capacity to add to the number of fins on each tube, but too many or too close fin spacing on the tube will certainly impede the natural convection of the air flowing upwardly through the fins so as to reduce the above heat transfer coefficient, this is apparent from the corresponding drops in both curves in FIG. 8. By study of the above, the amount of heat from all the fins on the tube can be understood to have a certain maximum value in relation to the varying numbers of the fins, as shown in FIG. 9, which is introduced to simply show the general variation of the amount of heat released from all the fins on the tube of limited length with increasing numbers of fins. Accordingly, it is assumed that the fins on the tube should be spaced apart at a maximum distance so as not to reduce materially the heat transfer coefficient so that each tube can have along a limited length as many fins as it is capable of releasing heat effectively.

Figure 10:
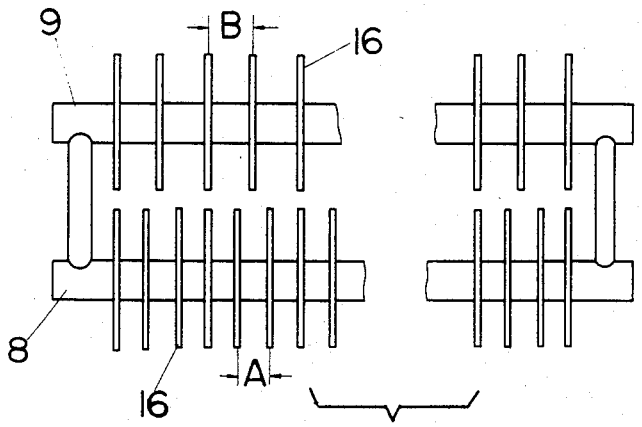
FIG. 10 is an elevational view showing partially in cutaway a still further embodiment of the present invention.
Figure 11:
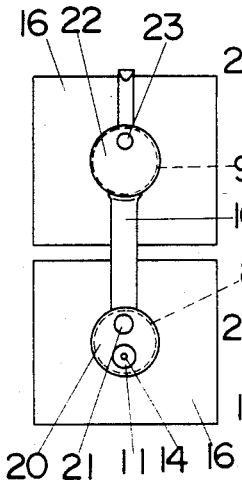
FIG. 11 is a side view showing an additional embodiment of the present invention.
Figure 12:
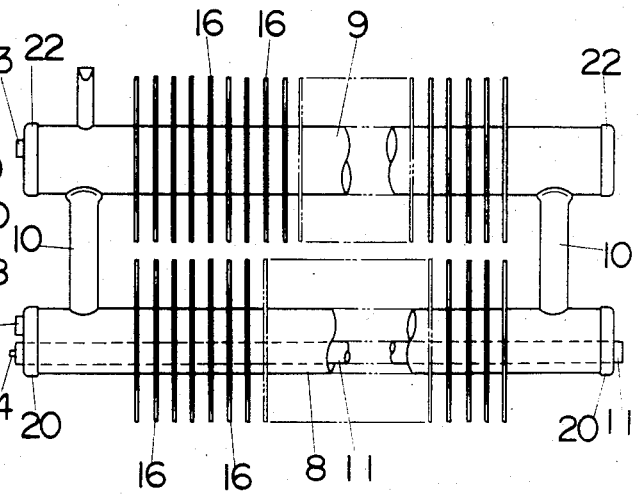
FIG. 12 is an elevational view of the heat pipe apparatus as shown in FIG. 11.
Figure 13:
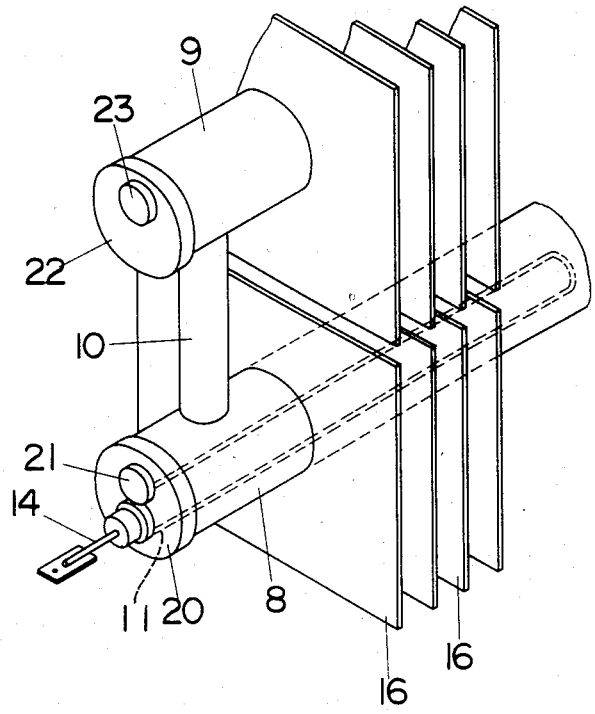
FIG. 13 is an enlarged view showing the end portion of the apparatus as shown in FIG. 11.

We now turn back to the discussion with regard to the effectiveness in releasing heat from both upper and lower tubes disposed in vertically tandem arrangement. Prior to advancing the discussion, it should be noted that the vertically disposed arrangement is advantageous fo the purpose of saving space in which the apparatus is installed over the possible arrangement in which the tubes of the same length and having the same numbers of fins is aligned longitudinally or disposed laterally, since the latter arrangements will require much wider or deeper spacing near the wall of a room in which the apparatus is installed and such spacing is difficult to spare in a normal situation. The following discussion should therefore be understood to raise the issue of effectiveness in heat transferring capacity of the lower tube in relation to that of the upper tube and vice versa for the purpose of increasing the total amount of heat to be released from the whole apparatus. As is known from the previous discussion, the air should flow through the fins rapidly rather than staying thereabout to allow the fins to continuously receive fresh air of lower temperature so that the amount of heat given off to the air can be increased for the apparatus while using convection heating. Therefore, each tube may be designed independently to have as many fins at such a minimum spacing therebetween as to increase te amount of heat from each tube. However, there arise a serious problem in this attempt because the fins on the thus constructed upper tubes can certainly impede the air flow passing through the fins on the lower tube by natural convection so as to largely reduce the amount of heat released from the lower tube, and therefore the above assumed structure will apparently fail to effectively increase the total heating capacity. To overcome this problem, the present invention is devised to provide a still further embodiment, as illustrated in FIG. 10, in which the fins on the uppper or secondary tube 9 are arranged to be at a wider spacing along the length thereof than those on the lower or main tube 8. Although it may seem to hold effective for the purpose of attaining higher flowability of the air passing through the fins of both tubes to reduce the number of fins on either of the upper and lower tubes in differing numbers or equal numbers, it is still more effective to place a larger number of fins 16 on the lower tube 8 rather than to the upper tube 9. When considering the above teaching that the fins on the lower tube 8 are subject to air of lower temperature, it has the function of giving off more heat than those on the second tube. This is the reason why the present embodiment adopts the arrangement that the fins 16 on the upper or secondary tube 9 are spaced longitudinally along the length thereof at a wider clearance (B) than the clearance (A) for the fins 16 on the lower tube 8, in other words, the upper tube 9 has a smaller number of fins 16 thereon than the lower tube. The particular values for the differing clearances respectively for the fins on the upper and lower tubes may be chosen depending on the capacity of the heat source employed, the materials as well as the dimensions of the tubes and the fins, and like factors.

Figure 14:
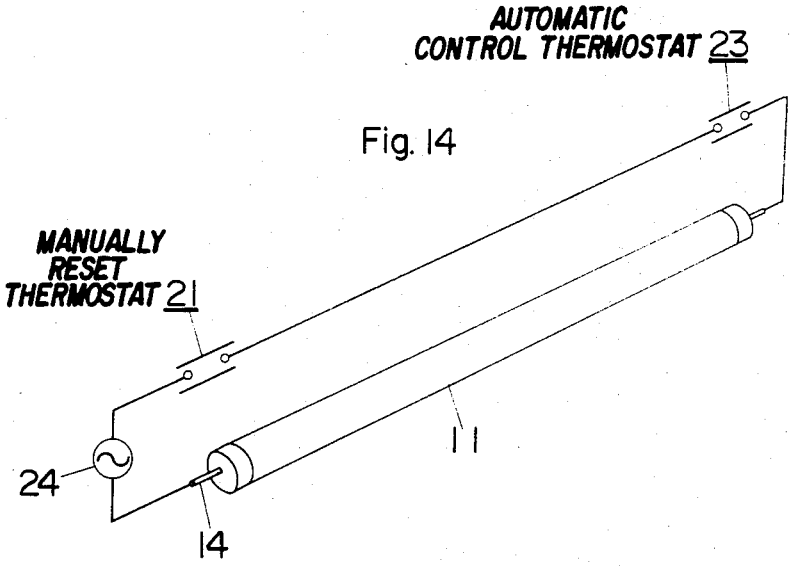
FIG. 14 is a schematic representation of the electric connection between a sheath heater employed as the heat source of the apparatus and thermostats connected to prevent the apparatus from overheating.

With reference to FIGS. 11 through 14 which show an additional embodiment of the present invention, which includes useful means for preventing unusual or excessive heating of the apparatus. The means comprises at least one first thermostat 21 mounted on either of end caps 20 closing the longitudinal ends of the main tube 9 and at least one second thermostat 23 mounted on either of end caps 22 likewise closing the longitudinal ends of the secondary tube 9. As seen in FIG. 14, these thermostats and the heat source 14 are connected in series with an ac power source 24. The first thermostat 21 is of the type which is reset only by manually operated reset means connected thereto and senses the wall temperature of the main tube 8 to disconnect the heat source 14 when the temperature reaches a predetermined value, while the second thermostat 22 is of the type which is automatically reset, senses and wall temperature of the secondary tube 9 representative of the whole apparatus to disconnect the heat source 14 when that temperature reaches another predetermined value. It automatically reconnects the heat source 14 when the temperature falls to a lower value, the first thermostat 21 being selected to disconnect the heat source 14 at a higher temperature than that at which the second thermostat 23 operates to disconnect the same.

The operation of the above thermostats 21 and 23 are as follows. When the air passing through the apparatus by natural convection is obstructed for example, by an accidental closure of the upper port and/or the lower port of the said housing 1 in which the apparatus is incorporated so that the apparatus is heated to an excessive high temperature, but immediately after the apparatus is heated to such a higher temperature, the first thermostat 21 operates to disconnect the heat source 14 to prevent further heating. When, on the other hand, the main tube 8 is emptied of the working fluid by leakage or when the main tube is inclined with respect to its horizontal position to an extent that the heat source 14 or the protective pipe 11 rises out of the working fluid in the liquid form, the heat source 14 will suffer a partial and excessive heating as to cause particularly the main tube 8 to have an excessive high temperature. In this event the second thermostat 23 responds to disconnect the heat source 14 until it is reset by a manual switch after curing the trouble. With the above provisions the first thermostat 21 is capable of being automatically reset, whereas the second thermostat 23 cannot be reset unless a person manipulates the manual reset means. The second thermostat is set to operate at a higher temperature than the first thermostat 21, thus it is possible that the apparatus can resume its operation automatically in response to the lowering in the temperature of the apparatus from an excessive higher temperature when the apparatus itself has no defect, but that the apparatus will not resume operation if the temperature falls to normal in the case of the apparatus being damaged or not used properly. The latter is particularly important in that the apparatus is prevented from being subject to repeated excessive heating as would otherwise occur each time at the lowering of the temperature if the second thermostat were of the type to automatically reset, such repeated heating would be most likely to completely damage the apparatus and should therefore be avoided for the sake of ensuring the safe operation of the apparatus. Additionally, the first and second thermostats are not limited to be mounted on the respective end caps and may be chosen to be in any location so long as these thermostats can sense the temperature of the corresponding tubes. Further, additional first and second thermostats may be used. It is of course available for disconnecting the heat source 14 to employ conventional fuses in place of the above thermostats.

The above embodiments and particularly the drawings are set forth for purposes of illustration only. It will be understood that many variations and modifications of the embodiment herein described will be obvious to those skilled in the art, and may be carried out without departing from the spirit and scope of the invention.

What is claimed is:

1. An electric space heater comprising a housing having:

a substantially straight and uniform diameter main tube adapted to be disposed substantially horizontally, a substantially straight and uniform diameter secondary tube arranged to be above and in substantially parallel relationship with said main tube, conduit pipe means extending upwardly from the main tube to the secondary tube and interconnecting the tubes to define a closed space within the tubes and conduit pipe means;

an elongated heat source extending axially through only the main tube, said heat source including an elongated protective pipe extending through the length of the main tube and having its end portions sealed respectively in end walls of the main tube and an electric resistance heating element extending the entire length of the protective pipe and having its ends projecting therefrom for connection to a power source, the secondary tube being empty;

a vaporizable working fluid in the space within the main tube and being in liquid phase at the operating temperature of the apparatus so as to entirely immerse only the heat source in the fluid, but having the remainder of the closed space empty for expansion of vaporized working fluid thereunto;

said main and secondary tubes being provided respectively with radiation fins evenly spaced along the length thereof, with the fins on the secondary tube being spaced at a wider clearance than those on the main tube; and said working fluid in the main tube absorbing the heat from the heat source to vaporize and expand in all regions of said closed space and condensing on the inner surface forming the closed space so as to give up its latent heat of vaporization to the surrounding air and then returning through the conduit pipe means to the main tube.

2. The heat pipe apparatus as set forth in claim 1, wherein the main tube is provided with a first thermostat to interrupt the heat source when the temperature in the main tube reaches a predetermined value and be only reset by manual reset means connected thereto, and wherein the secondary tube is provided with a second thermostat to interrupt the heat source when the temperature in the secondary tube reaches another predetermined value and automatically reconnect it when the temperature falls to a lower value, the temperature at which the first thermostat operates to interrupt the heat source being set to be higher than that for the second thermostat.

3. The space heater of claim 1 in which the closed space defined by the tubes and conduit pipe means is exhausted of air so as to facilitate vaporization of the working fluid.

* * * * *